United States Patent [19]

Symons

[11] 4,393,332

[45] Jul. 12, 1983

[54] GYROTRON TRANSVERSE ENERGY EQUALIZER

[75] Inventor: Robert S. Symons, Los Altos, Calif.

[73] Assignee: Varian Associates, Inc., Palo Alto, Calif.

[21] Appl. No.: 184,497

[22] Filed: Sep. 5, 1980

[51] Int. Cl.[3] ..... H01J 25/00

[52] U.S. Cl. ..... 315/4; 315/3; 330/43

[58] Field of Search ..... 315/3, 4, 5; 333/34, 333/230; 330/4.6, 4.7, 43

[56] References Cited

U.S. PATENT DOCUMENTS

| | | | |
|---|---|---|---|
| 3,398,376 | 8/1968 | Hirshfield | 315/5 |
| 3,463,956 | 8/1969 | Jory et al. | 315/5 |
| 4,199,709 | 4/1922 | Alirot et al. | 315/4 |
| 4,200,820 | 4/1980 | Symons | 315/4 |
| 4,282,458 | 8/1981 | Barnett | 315/4 |

FOREIGN PATENT DOCUMENTS

| | | | |
|---|---|---|---|
| 55-113240 | 1/1980 | Japan | 315/4 |

*Primary Examiner*—Saxfield Chatmon, Jr.
*Attorney, Agent, or Firm*—Stanley Z. Cole; Robert B. Nelson; Peter J. Sgarbossa

[57] ABSTRACT

In a Gyrotron electron tube, oscillating motion perpendicular to the axis of a linear electron beam is produced by a helical component of magnetic field. The length along the beam of the helical field is critically chosen so that electrons at various radii from the axis all acquire equal transverse energy.

7 Claims, 5 Drawing Figures

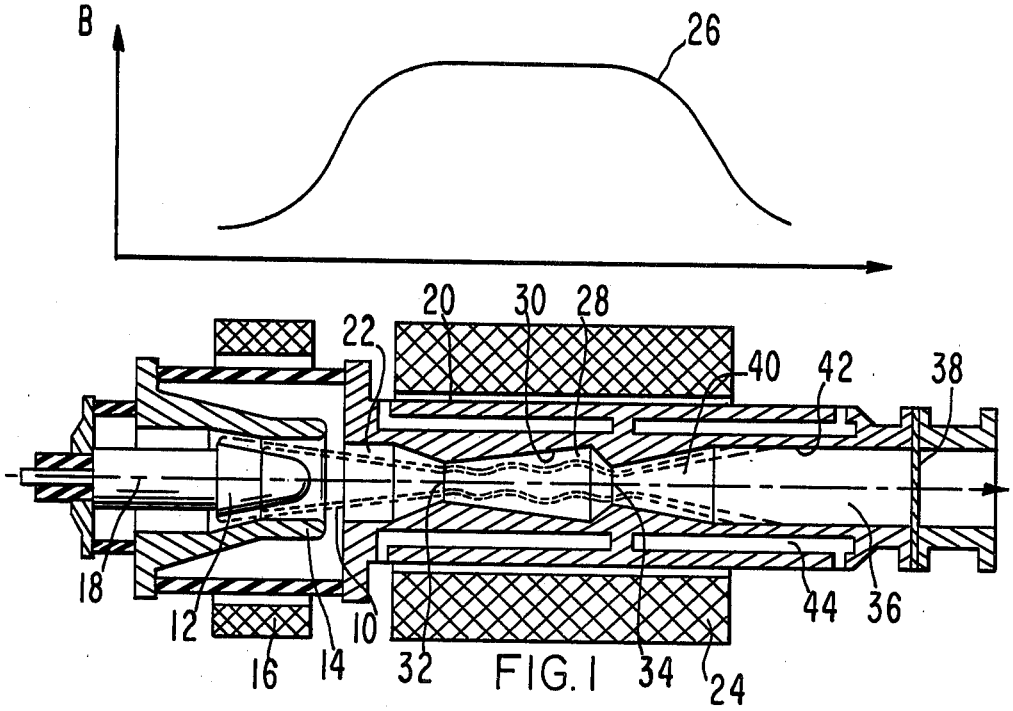
FIG. 1
FIG. 2
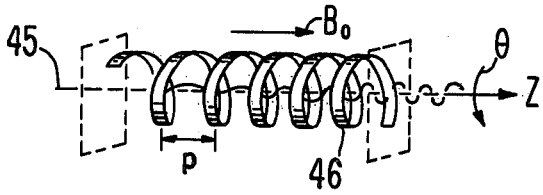
FIG. 3
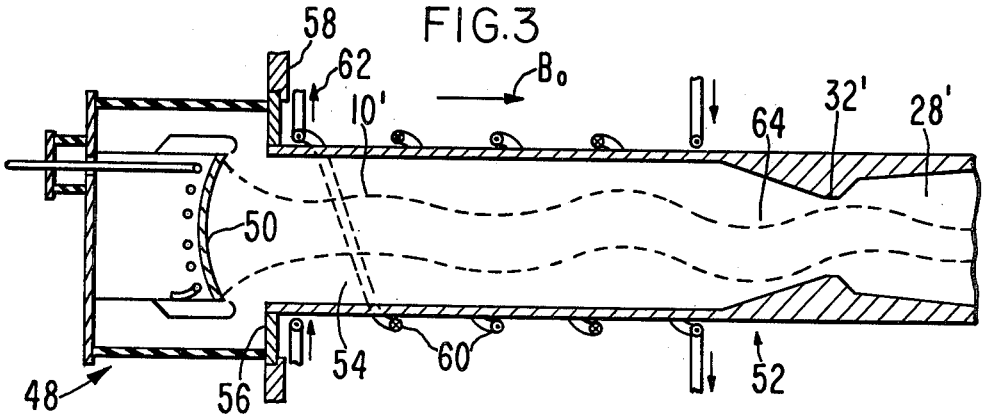

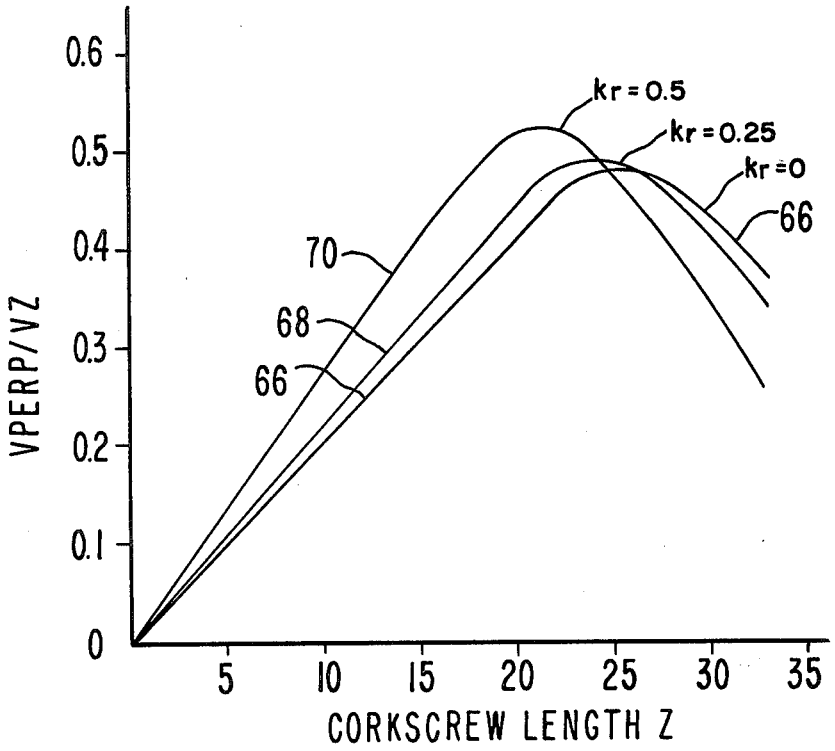
0.6
0.5
0.4
0.3
0.2
0.1
0
VPERP/VZ
kr = 0.5
kr = 0.25
kr = 0
66
70
68
66
5
10
15
20
25
30
35
CORKSCREW LENGTH Z
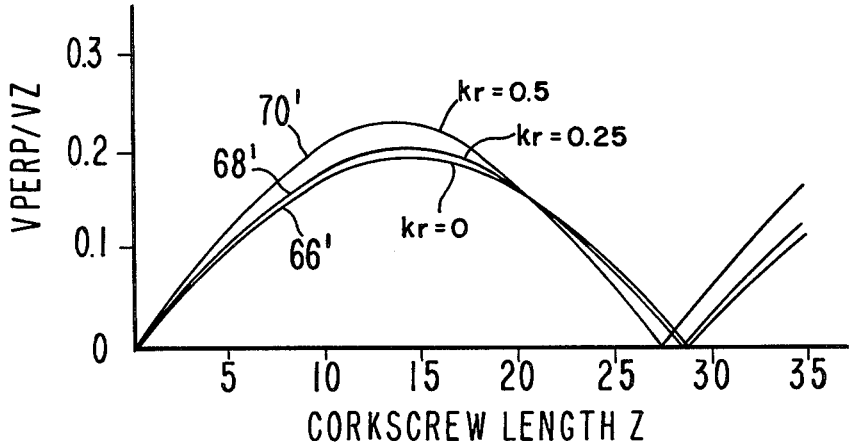
0.3
0.2
0.1
0
VPERP/VZ
70'
68'
66'
kr = 0.5
kr = 0.25
kr = 0
5
10
15
20
25
30
35
CORKSCREW LENGTH Z

GYROTRON TRANSVERSE ENERGY EQUALIZER

The Government has rights in this invention pursuant to Contract No. F30602-78-C-001 awarded by the Department of the Air Force.

DESCRIPTION

1. Field of the Invention

The invention relates to electromagnetic wave generators for very high frequency and high power levels. A most promising device in this field is the "Gyrotron" in which a linear beam of electrons in an axial magnetic field is made to convert axial energy into an oscillating motion transverse to the axial field. The transverse motion interacts with the transverse electric field of an electromagnetic wave such as a circular-electric-field mode of a cylindrical cavity, whereby the wave is amplified. The gyrotron has the advantage over traditional klystrons and traveling wave tubes that the electromagnetic circuit may be much larger than the free-space wavelength of the generated wave.

2. Prior Art

Previous gyrotrons utilized a hollow beam of electrons drawn from a magnetron gun. Such a gun is described in U.S. Pat. No. 3,258,626 issued June 28, 1966 to G. S. Kino and N. J. Taylor. The electrons drawn radially from the cathode surface toward the surrounding anode immediately acquire rotational velocity about the axis by cutting the axial magnetic field. This rotating hollow beam is introduced into a cavity supporting a circular-electric-field mode standing electromagnetic wave. The rotational velocity component interacts with this wave, producing cyclotron-frequency orbiting of electrons in a uniform axial magnetic field. The transverse radio-frequency electron current exchanges energy to the electric field component of the wave, which grows as the beam proceeds through the cavity, generating the useful output wave. These tubes have the disadvantage that the beam is necessarily hollow so that the cavity must be large to handle a high beam current. Thus problems arise with spurious modes and radiation through the beam entrance and exit apertures.

A method of converting axial energy of charged particles in a magnetic field into transverse energy was described by Richard C. Wingerson in Physical Review Letters, May 1, 1961, pages 446–448. This "corkscrew" is a device to produce a helical component of magnetic field having a pitch such that axially moving electrons interact with it at their cyclotron frequency. Thus electrons having no initial transverse velocity can rapidly interact with the helical field to convert their axial energy to transverse, even up to 100%.

Wingerson considered his device as a reflecting mirror for magnetically confined particles. It has lately been suggested as a means to generate transverse velocities in an electron beam for gyrotron interaction. In this use it has the advantage that the beam need not be hollow, so more current can be passed through smaller entrance and exit apertures, diminishing the problem of radiation loss through them.

The corkscrew field has one great disadvantage. The helical field is produced by a field generator outside the beam, and hence is stronger near the outside of the beam than it is near the axis. Thus electrons at various radii have different transverse energies, limiting the efficiency of gyrotron interaction.

SUMMARY OF THE INVENTION

An object of this invention is to provide a gyrotron wave generator of improved efficiency.

A further object is to provide a gyrotron generator having reduced radiation losses.

A further object is to provide a generator with reduced spurious modes.

These objects are achieved by using a helical magnetic field to produce transverse velocities whereby a small diameter entrance orifice to prevent spurious radiation therethrough, and a small diameter interaction cavity with a low-order circular-electric-field mode whereby spurious modes are discouraged. The axial length of the helical field is critically set such that electrons at different radii from the axis emerge from the helical field with the same transverse energy.

BRIEF DESCRIPTION OF THE DRAWINGS

FIG. 1 is a schematic axial section of a prior-art Gyrotron.

FIG. 2 is an illustration of a new method of inducing rotational velocity.

FIG. 3 is an axial section of the resonator portion of a gyro-klystron oscillator employing a helical magnetic field.

FIG. 4 is a graph of the transverse energy in a beam in a helical field.

FIG. 5 is a graph similar to FIG. 3 for different parameters.

DESCRIPTION OF THE PREFERRED EMBODIMENTS

FIG. 1 shows schematically a prior-art gyro-kylstron oscillator. A hollow beam of electrons 10 is drawn from a conically tapered thermionic cathode 12 by a positive potential applied to a surrounding hollow anode 14. This "magnetron injection gun" is immersed in an axial magnetic field produced by a surrounding solenoid 16. Such a gun is described in U.S. Pat. No. 3,258,626 issued June 28, 1966 to G. S. Kino and N. J. Taylor and assigned to the assignee of the present invention. As the electrons 10 are drawn from cathode 12 they cut the magnetic field lines and are given some rotational velocity about the axis 18. Both cathode 12 and anode 14 are tapered so there is an axial component of electron velocity which draws electron stream 10 out of the gun as a hollow beam rotating about its axis and progressing in the direction of decreasing diameter of the electrodes 12 and 14.

Electron stream 10 is drawn by a further more positive potential into the main body 20 of the gyrotron. In the entrance area 22 the axial magnetic field formed by a second solenoid 24 increases greatly. Beam 10 is thereby compressed in diameter. Also, its speed of rotation about the axis is increased while its axial velocity is decreased. Axial energy is converted into rotational energy. Graph 26 shows the value of axial magnetic field vs. axial position in the gyrotron directly below.

After beam 10 is compressed, it enters the interaction cavity 28. This is a circularly symmetric cavity with high-conductivity walls of copper. Cavity 28 is dimensioned to be electromagnetically resonant in a mode with circular electric field perpendicular to the axis. This can be the lowest-order mode $TE_{ol}$. Alternatively it may be a higher-order mode $TE_{om}$ where m is the number of field maxima between axis 18 and the cavity outer wall 30. At the beam input end cavity wall 30 is constricted to form an aperture 32 of diameter small enough to prevent transmission of the cavity wave with consequent loss of energy. At the beam output end a similar aperture 34 is not completely cut off for the wave but allows the desired fraction to pass into the output waveguide 36 and emerge through the dielectric vacuum window 38 to enter a useful load (not shown).

In operation, the rotational velocity component of electron beam 10 interacts with the circular electric field of the cavity standing wave to produce a component of rotational motion about the magnetic field lines. This rf component induces further energy into the standing wave, thus supporting a continuous oscillation and generating useful microwave power. The advantage of the gyrotron for very high powers and frequencies is that the resonant cavity has dimensions of many free-space wavelengths instead of the fraction of a wavelength for klystron cavities. Also the beam may be several wavelengths in diameter.

Interaction cavity 28 is tapered larger in diameter toward its output end so that the amplitude of the standing wave increases for cumulative interaction.

After leaving cavity 28, beam 10 enters a region 40 of decreasing magnetic field and its diameter increases accordingly until it is collected on the outer wall 42 of propagating waveguide 36 which is cooled by water channels 44. Thus the functions of beam collector and output waveguide are combined.

One problem with this prior-art gyrotron is that the original rotational beam velocity derives from the magnetron gun. The amount of rotational velocity is determined by the characteristics of the gun and cannot be individually chosen. Also, the beam is intrinsically hollow and hence must be larger than a solid beam of the same current density. The larger beam causes more problems with unwanted electromagnetic modes and leakage through the apertures.

A suggestion for an improved way to introduce rotational energy on a beam of charged particles was made by Richard C. Wingerson in Physical Review Letters, Vol. 6, No. 9, May 1, 1961, pages 446–448. This scheme is to pass the beam through an axial magnetic field to which has been added a corkscrew component. FIG. 2 illustrates the apparatus and the result. The beam 45 flowing in the direction of axial field $B_o$ goes through a helical magnet 46 which is an iron strip magnetized by the axial field. The transverse component of magnetic field rotates in direction as one progresses down from the axis. The pitch p of the corkscrew is made equal to the cyclotron wavelength (the axial distance a particle travels in the time it takes to make one revolution in the uniform axial field $B_o$). As the particles lose axial velocity by converting it to rotational velocity the cyclotron wavelength decreases, so the helix pitch p is tapered shorter. For electron beams of relativistic energy the change of velocity with energy is much less than for heavy particles and the taper may not be needed.

FIG. 3 is a schematic axial section of the region of a gyrotron wherein rotational energy is introduced by a corkscrew field. This gyrotron application is described in U.S. Pat. No. 3,398,376 issued Aug. 20, 1968 to J. L. Hishfield.

In FIG. 3 beam 10' is a solid pencil beam originating from a conventional electron gun 48 of the type used in klystrons and traveling wave tubes. The concave thermionic cathode 50 is at a potential negative to the gyrotron body 52, whereby the converging beam 10' is drawn into the hollow bore 54 of body 52. At the end of bore 54 is a steel plate 56 which fits into the steel shield 58 which is the terminal polepiece of the axial magnetic shield. Thus cathode 50 is partially shielded from axial field.

Starting where beam 10' is in bore 54, there is a corkscrew magnetic field produced by a bifilar helix 60 carrying counter-rotating D.C. as shown by the arrows 62. For pulsed operation, low frequency A.C. might be used. The corkscrew field converts axial energy to rotational energy as described by Wingerson. The amount of rotational energy depends on the strength and the length of the corkscrew field and is completely selectable by the designer. At a point where the rotational energy is the desired value. The corkscrew field is terminated and the beam is compressed by increasing the axial field through a compression region 64. This compression further increases the rotational energy at the expense of axial energy. Since the rotational energy is what generates the microwaves, it should be most of the total. At the end of compression region 64 the beam passes through the input aperture 32' into the resonant interaction cavity 28'. The rest of the gyrotron is similar to that of FIG. 1 except that with the solid beam the output window must be shielded from electrons near the axis.

The invention provides an optimum length for the corkscrew field. FIG. 4 is a plot from calculated electron trajectories of the ratio of electron energy perpendicular to the axis V PERP to energy parallel to the axis VZ, vs. length Z of the corkscrew field. The corkscrew field strength is 1% of the axial field and the periodic length is exactly the cyclotron wavelength. For a beam having no transverse energy, the three curves are for: 66, electrons at the center of the original axially symmetric beam; 68, electrons starting at $kr=0.25$ where k is the radial propagation constant and r is the entering radius; and 70, starting at $kr=0.5$ which is about the largest beam that would be used. Each graph shows transverse energy going through a maximum and then decreasing as the transfer of axial energy causes the beam modulation to get out of synchronism with the helix. The scale of length Z is unimportant here. The invention consists in using a length of corkscrew field such that the transverse energies are essentially equal for electrons of different starting radii. This would be $Z=25$ in the case of FIG. 4. The value of course depends also on the strength of the corkscrew field.

FIG. 5 is a graph similar to FIG. 4 except it is for the case where the cyclotron wavelength is 10% shorter than the pitch of the corkscrew field. In this case the electrons get out of synchronism sooner and the optimum length for equal transverse energies is $Z=22$.

It appears that the important parameter for optimum length in a given structure is the product of the cyclotron wavelength $\lambda_c$ and the strength of corkscrew field.

I claim:

1. A gyrotron electron tube comprising:

means for generating a beam of electrons parallel to an axis; and periodic means for causing all electrons in said beam to gain approximately the same transverse energy, said periodic means including means for generating a steady field component perpendicular to said axis whose direction rotates about said axis as a periodic function of distance along said axis.

2. The tube of claim 1 wherein said steady field is a magnetic field.

3. The tube of claim 2 wherein said periodic means comprises a bifilar helix for conducting counterrotating electric currents.

4. A method for operating a gyrotron electron tube comprising means for forming a beam of electrons parallel to an axis, said method comprising the steps of applying a steady periodic field component perpendicular to said axis whose direction rotates about said axis as a periodic function of distance along said axis, and correlating the strength and axial length of said periodic field so that all electrons in said beam at different initial distances from said axis acquire approximately the same transverse energy.

5. The method of claim 4 wherein said steady field is a magnetic field.

6. The method of claim 5 wherein said steady field is generated by passing electric current through a bifilar helical conductor outside said beam, said current being of opposite direction in adjacent turns.

7. In a gyrotron tube:

means for generating a beam of electrons parallel to an axis; and means for generating a steady periodic field component perpendicular to said axis whose direction rotates about said axis as a periodic function of distance along said axis and whose strength and axial length are correlated to impart the same transverse energy gain to all electrons in said beam despite differences in initial electron distances from said axis.

* * * * *